US006238253B1

(12) United States Patent
Qualls

(10) Patent No.: US 6,238,253 B1
(45) Date of Patent: May 29, 2001

(54) BATTERY TERMINAL GRIPPING ASSEMBLY

(76) Inventor: Phillip L. Qualls, 201 Utah Meadow Rd., Rio Rancho, NM (US) 87124

( * ) Notice: Subject to any disclaimer, the term of this patent is extended or adjusted under 35 U.S.C. 154(b) by 0 days.

(21) Appl. No.: 09/519,754

(22) Filed: Mar. 6, 2000

(51) Int. Cl.[7] ..... H01R 4/48
(52) U.S. Cl. ..... 439/759; 439/822
(58) Field of Search ..... 439/726, 754, 439/755, 756, 504, 759, 822, 506; 320/105

(56) References Cited

U.S. PATENT DOCUMENTS

| | | | | |
|---|---|---|---|---|
| D. 258,818 | | 4/1981 | Johnson et al. . | |
| 2,762,028 | | 9/1956 | Coningh et al. . | |
| 3,267,452 | | 8/1966 | Wolf . | |
| 3,936,121 | * | 2/1976 | Leinberger | 439/489 |
| 4,153,321 | * | 5/1979 | Pombrol | 439/437 |
| 4,163,134 | * | 7/1979 | Budrose | 200/157 |
| 4,378,525 | * | 3/1983 | Burdick | 324/127 |
| 4,449,772 | * | 5/1984 | Johnson, III | 439/504 |
| 4,463,402 | * | 7/1984 | Cottrell | 361/77 |
| 4,826,457 | | 5/1989 | Varatta . | |
| 4,869,688 | * | 9/1989 | Merio | 439/504 |
| 4,923,415 | | 5/1990 | Lee . | |
| 5,002,508 | * | 3/1991 | Craveiro | 439/755 |
| 5,021,008 | * | 6/1991 | Scherer | 439/504 |
| 5,167,529 | | 12/1992 | Verge . | |
| 5,435,759 | * | 7/1995 | Adams et al. | 439/755 |
| 5,634,814 | * | 6/1997 | Krivec | 439/441 |

* cited by examiner

*Primary Examiner*—Tulsidas Patel
*Assistant Examiner*—Hae Moon Hyeon

(57) ABSTRACT

A booster cable assembly for connecting to the terminal of a battery. The booster cable assembly includes a terminal gripping assembly for gripping a battery terminal. The gripping assembly includes a pair of arms. Both of the arms have a distal portion, a proximal portion and central portion. The arms each have a front face, a back face, a top face and a bottom face. A pivoting assembly pivotally couples the first and second arms such that each of the front faces face each other. A biasing means biases said arms in an open position. The biasing means is a torsion spring. The biasing means urges the front faces of the arms away from each other. A cable operationally connects the terminal gripping assembly to a second terminal gripping assembly. The cable has a first end fixedly coupled to the proximal portion of the second arm.

13 Claims, 5 Drawing Sheets

BATTERY TERMINAL GRIPPING ASSEMBLY

BACKGROUND OF THE INVENTION

1. Field of the Invention

The present invention relates to booster cables and more particularly pertains to a new booster cable assembly for connecting to the terminal of a battery.

2. Description of the Prior Art

The use of booster cables is known in the prior art. More specifically, booster cables heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,167,529; U.S. Pat. No. 2,762,028; U.S. Pat. No. 4,923,415; U.S. Pat. No. 3,267,452; U.S. Des. Patent No. 258,818; and U.S. Pat. No. 4,826,547.

While these devices fulfill their respective, particular objectives and requirements, the aforementioned patents do not disclose a new booster cable assembly. The inventive device includes a terminal gripping assembly for gripping a battery terminal. The gripping assembly includes a pair of arms. Both of the arms have a distal portion, a proximal portion and central portion. The arms each have a front face, a back face, a top face and a bottom face. A pivoting assembly pivotally couples the first and second arms such that each of the front faces face each other. A biasing means biases said arms in an open position. The biasing means is a torsion spring. The biasing means urges the front faces of the arms away from each other. A cable operationally connects the terminal gripping assembly to a second terminal gripping assembly. The cable has a first end fixedly coupled to the proximal portion of the second arm.

In these respects, the booster cable assembly according to the present invention substantially departs from the conventional concepts and designs of the prior art, and in so doing provides an apparatus primarily developed for the purpose of connecting to the terminal of a battery.

SUMMARY OF THE INVENTION

In view of the foregoing disadvantages inherent in the known types of booster cables now present in the prior art, the present invention provides a new booster cable assembly construction wherein the same can be utilized for connecting to the terminal of a battery.

The general purpose of the present invention, which will be described subsequently in greater detail, is to provide a new booster cable assembly apparatus and method which has many of the advantages of the booster cables mentioned heretofore and many novel features that result in a new booster cable assembly which is not anticipated, rendered obvious, suggested, or even implied by any of the prior art booster cables, either alone or in any combination thereof.

To attain this, the present invention generally comprises a terminal gripping assembly for gripping a battery terminal. The gripping assembly includes a pair of arms. Both of the arms have a distal portion, a proximal portion and central portion. The arms each have a front face, a back face, a top face and a bottom face. A pivoting assembly pivotally couples the first and second arms such that each of the front faces face each other. A biasing means biases said arms in an open position. The biasing means is a torsion spring. The biasing means urges the front faces of the arms away from each other. A cable operationally connects the terminal gripping assembly to a second terminal gripping assembly. The cable has a first end fixedly coupled to the proximal portion of the second arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new booster cable assembly apparatus and method which has many of the advantages of the booster cables mentioned heretofore and many novel features that result in a new booster cable assembly which is not anticipated, rendered obvious, suggested, or even implied by any of the prior art booster cables, either alone or in any combination thereof.

It is another object of the present invention to provide a new booster cable assembly which may be easily and efficiently manufactured and marketed.

It is a further object of the present invention to provide a new booster cable assembly which is of a durable and reliable construction.

An even further object of the present invention is to provide a new booster cable assembly which is susceptible of a low cost of manufacture with regard to both materials and labor, and which accordingly is then susceptible of low prices of sale to the consuming public, thereby making such booster cable assembly economically available to the buying public.

Still yet another object of the present invention is to provide a new booster cable assembly which provides in the apparatuses and methods of the prior art some of the advantages thereof, while simultaneously overcoming some of the disadvantages normally associated therewith.

Still another object of the present invention is to provide a new booster cable assembly for connecting to the terminal of a battery.

Yet another object of the present invention is to provide a new booster cable assembly which includes a terminal gripping assembly for gripping a battery terminal. The gripping assembly includes a pair of arms. Both of the arms have a distal portion, a proximal portion and central portion. The arms each have a front face, a back face, a top face and a bottom face. A pivoting assembly pivotally couples the first and second arms such that each of the front faces face each other. A biasing means biases said arms in an open position. The biasing means is a torsion spring. The biasing means urges the front faces of the arms away from each other. A cable operationally connects the terminal gripping assembly to a second terminal gripping assembly. The cable has a first end fixedly coupled to the proximal portion of the second arm.

Still yet another object of the present invention is to provide a new booster cable assembly that has front faces biased away from each other so that the user may easier place the distal ends of the arms about the battery terminal.

Even still another object of the present invention is to provide a new booster cable assembly that has saddles on the front faces of the arms for a consistent connection with the battery terminal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
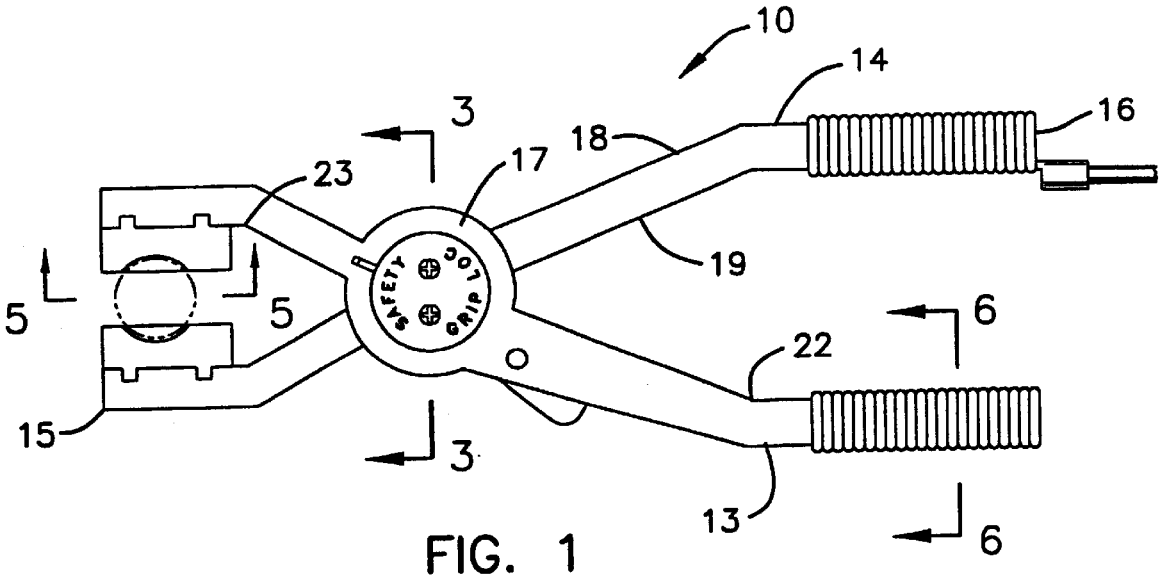
FIG. 1 is a schematic plan view of a new booster cable assembly according to the present invention.
Figure 2:
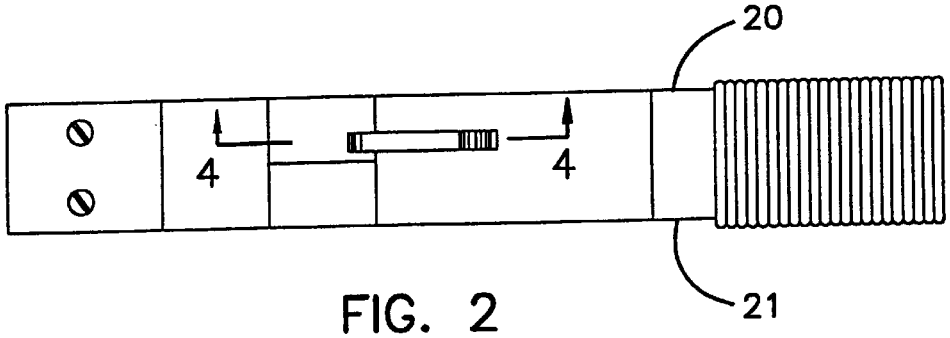
FIG. 2 is a schematic side view of the present invention.
Figure 3:
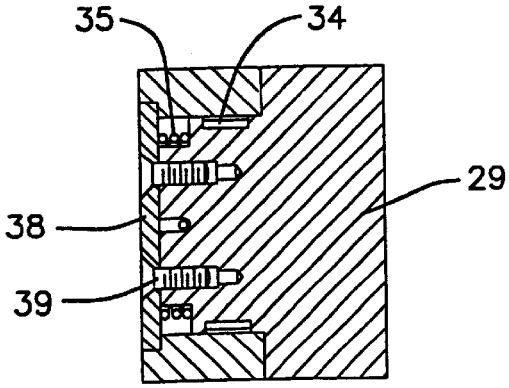
FIG. 3 is a schematic cross-sectional view taken along line 3—3 of the present invention.
Figure 4:
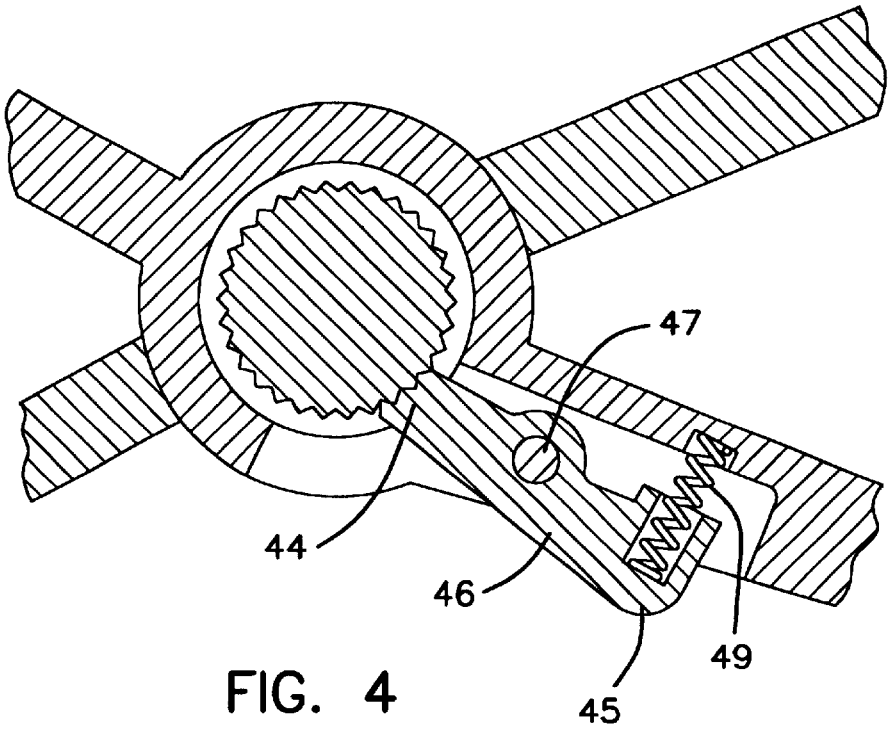
FIG. 4 is a schematic cross-sectional view taken along line 4—4 of the present invention.
Figure 5:
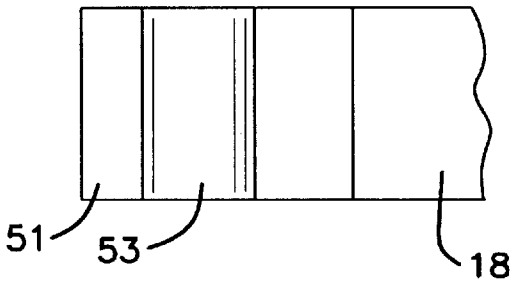
FIG. 5 is a schematic front view taken along line 5—5 of the present invention.
Figure 6:
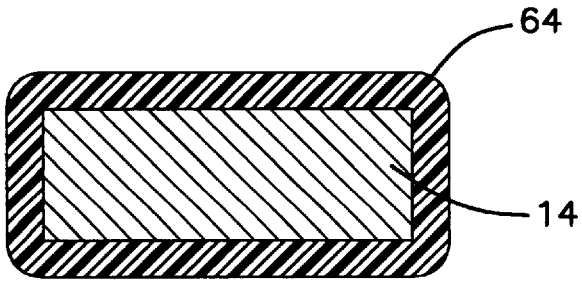
FIG. 6 is a schematic cross-sectional view taken along line 6—6 of the present invention.
Figure 7:
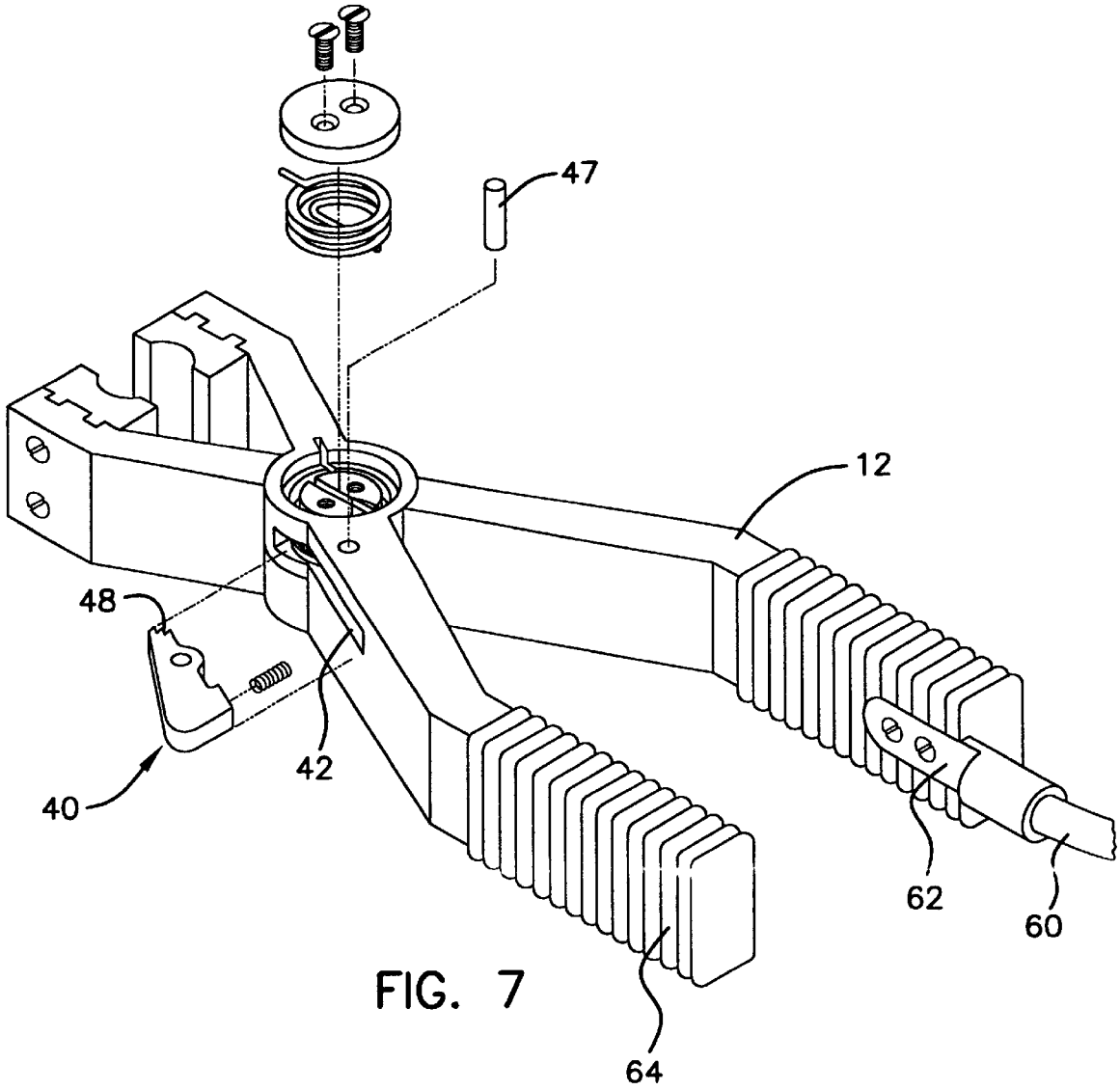
FIG. 7 is a schematic perspective expanded view of the present invention.
Figure 8:
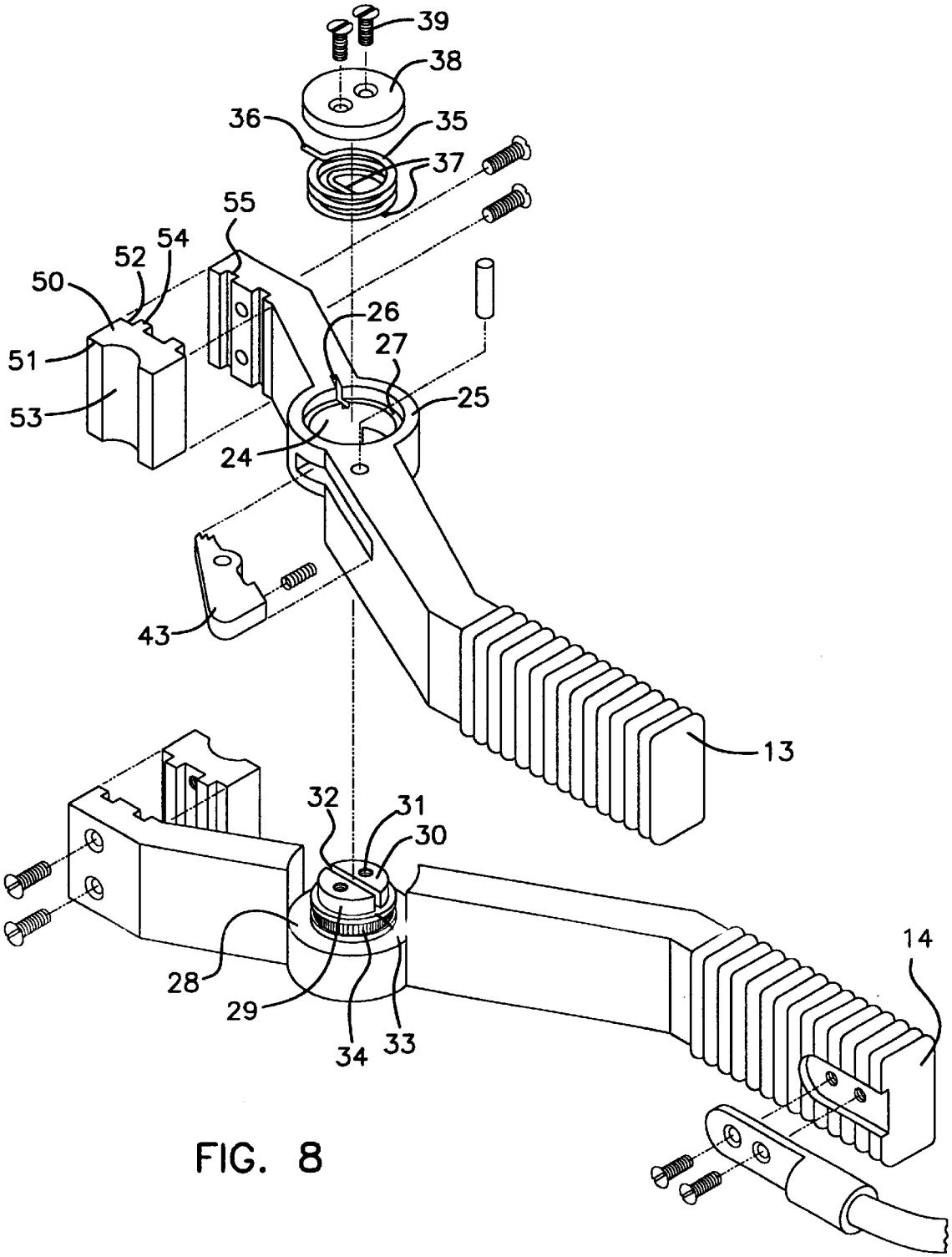
FIG. 8 is a schematic perspective expanded view of the present invention.

With reference now to the drawings, and in particular to FIGS. 1 through 9 thereof, a new booster cable assembly embodying the principles and concepts of the present invention and generally designated by the reference numeral 10 will be described.

As best illustrated in FIGS. 1 through 9, the booster cable assembly 10 generally comprises a terminal gripping assembly for gripping a battery terminal.

The terminal gripping assembly 12 has a pair of arms 13, 14. Both of the arms have a distal portion 15, a proximal portion 16 and central portion 17. The arms 13, 14 each have a front face 18, a back face 19, a top face 20 and a bottom face 21. Both of the arms have a first bend 22 and a second bend 23 therein. The first bend 22 is generally located between the proximal portion 16 and the central portion 17. The first bend 22 forms an obtuse angle in the back face 19 having a measurement generally greater than one hundred and thirty-five degrees. The second bend 23 is generally located between the distal portion 15 and the central portion 17 and forms an obtuse angle in the front face 18 having a measurement generally greater than one hundred and thirty-five degrees. Each of the arms 13, 14 is comprised of a conductive material such as steel or copper. The arms each have a generally rectangular shaped cross-section transverse to a longitudinal axis of the arms.

A pivoting assembly pivotally couples the first and second arms. The pivoting assembly first comprises a bore 24 in a first of the arms 13 in the central portion 17 which extends through the top 20 and bottom 21 faces. The front 18 and back faces 19 form an annular peripheral wall 25 about the bore 24. The annular peripheral wall 25 has an inside surface having a notch 26 therein. The notch 26 is generally located in the top face 20 of the first arm 13. The inside surface has an annular ridge 27 therein.

The second of the arms 14 has an annular groove 28 in the top face 20 of the central portion 17. An upstanding member 29 extends upwardly from a medial portion of the annular groove 28. The upstanding member 29 has a top wall 30 having two bores 31 therein. The top wall 30 has a slot therein 32. The upstanding member 29 an has an annular peripheral wall surface 30. The annular peripheral wall surface has an annular shoulder 33 therein to define an upper section and a lower section of the upstanding member. The lower section has an external surface has teeth 34 thereon.

A biasing means biases the arms 13, 14 in an open position. The biasing means is a torsion spring 35. The torsion spring 35 is generally wrapped about upstanding member 29. The torsion spring 35 has a first end 36 extending away from a central portion of the spring and a second end 37 extending toward a central portion of the torsion spring. The first end 36 of the torsion spring is insertable into the notch 26. The second end 37 is insertable in the slot 32 in the upstanding member 29. The biasing means urges the front faces of the first and second arms away from each other.

A securing means secures the first arm 13 to the second arm 14. The securing means has a covering member 38. The covering member 38 is a disc having a shape adapted to rest upon the annular ridge 27 in the bore 24 in the first arm 13.

A pair of fastening means fastens the cover 38 to the top wall 30 of the upstanding member 29. Each of the fastening means extends through the disc 38 and through one of the bores 31 in the top wall 30 of the upstanding member 29. Each of the fastening means is a screw 39.

A locking assembly 40 selectively locks the terminal gripping assembly in a closed position. The locking assembly 40 comprises an aperture 42 in the first arm 13. The aperture 42 is located in the front face 18 of the first arm 13. The aperture 42 is positioned generally adjacent to the central portion 17 of the first arm. The aperture extends into the bore 24 in the first arm. The aperture is elongate, having a longitudinal axis orientated generally parallel to the longitudinal axis of the first arm 13.

A pawl 43 selectively communicates with the teeth 34 in the lower section of the upstanding member 29. The pawl 43 has a first end 44, a second end 45 and middle section 46. The pawl 43 is positioned in the aperture 42 and a pin 47 hingedly couples the middle section 46 to an interior surface of the aperture 42. The first end 44 has a plurality of teeth 48 therein. The pawl 43 locks the first 13 and second arms 14 in a first pivoting position such that the front faces 18 may not move away from each other.

An urging means 49 in the aperture 42 urges the second end 45 of the pawl 43 outside of the aperture 42 in the locked position. The urging means 49 is insertable in the pawl 43 generally between the second end 45 and the middle section 46 of the pawl 43. The urging means 49 is a spring.

A pair of saddles 50 each has a front portion 51 and a back portion 52. Each of the front portions 51 has a slot 53 therein. Each of the slots 53 has a rounded surface, and each of the back portions 52 of the saddles 50 is fixedly coupled to one of the front faces 18 of the distal portions 15 of the first 13 and second 14 arms. Each of the slots 53 has a longitudinal axis is oriented generally perpendicular to the longitudinal axes of the first and second arms. The saddles 50 are comprised of conductive material of which many are known in the art. Each of the back portions 52 has a pair of protruding members 54 thereon for insertion into a pair of grooves 55 in each of the front faces 18 of the first 13 and second 14 arms. The saddles 50 are adapted to receive the battery terminal.

A cable 60 operationally connects the terminal gripping assembly to a second terminal gripping assembly, or to a battery charger. The cable 60 has a first end 62 fixedly coupled to the proximal portion 16 of the second arm 14.

An insulating means 64 electrically insulates the first 13 and second 14 arms. The insulating means 64 is a coating on the proximal portions 16 of the first 13 and second 14 arms. The insulating means 64 has a ribbed surface for easier gripping of the arms. The insulating means 64 comprises a non-conductive material such as plastic or an elastomeric material.

Figure 9:
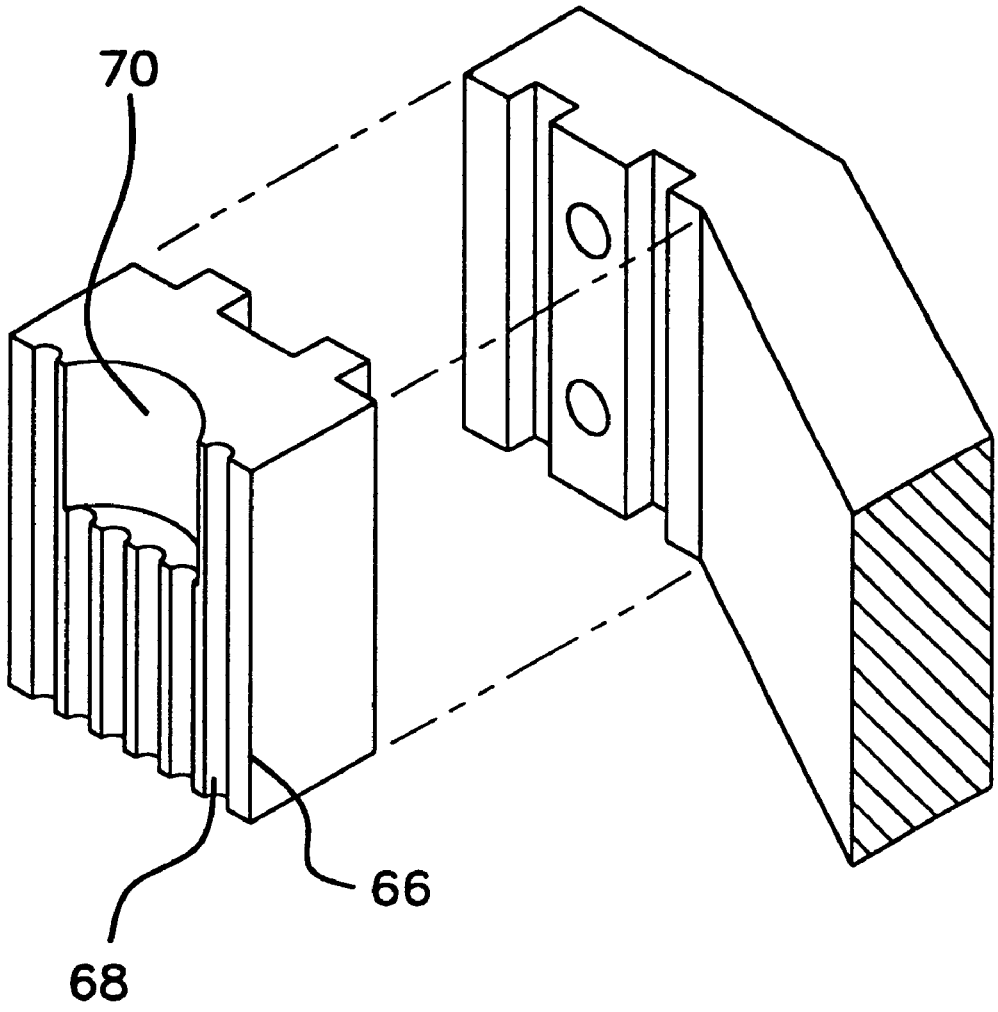
FIG. 9 is a schematic perspective view of the second embodiment of the present invention.

A second embodiment is depicted in FIG. 9. This embodiment has a saddle 66, having grooves 68 therein for additional grip. The slot 70 in the second embodiment only extends to a central portion of the saddle. This allows for versatile grip for varying terminals.

In use, the booster cable assembly is used as is any booster cable for boosting the electrical output of a battery. The booster cable assembly has arms having faces being urged away from each other. The user applies pressure on the proximal portions 16 of the arms 13, 14 to force the faces 18 towards each other and on the battery terminal. The locking assembly holds the faces in a closed position about the battery terminal. The pawl 43 is then actuated to allow the faces to move apart and release the terminal.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A battery terminal gripping assembly, said assembly being removably mountable to terminals of a vehicle battery, said assembly comprising:

a first terminal gripping assembly for gripping a battery terminal, comprising:

a pair of arms, both of said arms having a distal portion, a proximal portion and central portion, both of said arms having a front face for gripping a battery terminal, a back face, a top face and a bottom face, both of said arms having a first bend and a second bend therein, said first bend being generally located between said proximal portion and said central portions, said first bend forming an obtuse angle in said back face having a measurement generally greater than one hundred and thirty-five degrees, said second bend being generally located between said distal portion and said central portion, said second bend forming an obtuse angle in said front face having a measurement generally greater than one hundred and thirty-five degrees, each of said arms comprising a conductive material;

a pivoting assembly for pivotally coupling a first arm and a second arm of said pair of arms such that each of said front faces are facing each other, a biasing means biasing said arms in an open position, said biasing means being a torsion spring, wherein said biasing means urges said front faces of said arms away from each other;

a cable for operationally connecting said first terminal gripping assembly to a second terminal gripping assembly, said cable having a first end fixedly coupled to said proximal portion of said second arm;

said first arm of said pair of arms having a bore in said central portion and extending through said top and bottom faces, said front and back faces forming an annular peripheral wall about said bore; and said second arm of said pair of arms having an annular groove in said top face of said central portion, an upstanding member extending upwardly from a medial portion of said annular groove, said upstanding member being rotatably receivable in said bore in said first of said arms.

2. A battery terminal gripping assembly as in claim 1, wherein pivoting assembly further comprises:

said annular peripheral wall having an inside surface having a notch therein, said notch being generally located in said top face of said first arm;

said upstanding member having a top wall, said top wall having a slot therein; and said torsion spring being generally wrapped about upstanding member, said torsion spring having a first end extending away from a central portion of said spring and a second end extending toward a central portion of said torsion spring, said first end of said torsion spring being insertable into said notch, said second end being insertable in said slot in said upstanding member.

3. A battery terminal gripping assembly as in claim 2, said pivoting assembly further comprising:

a securing means for securing said first arm to said second arm, said securing means comprising:

said inside surface of said annular peripheral wall having an annular ridge therein;

said top wall of said upstanding member having two bores therein;

a covering member, said covering member being a disc having a shape rest upon said annular ridge in said bore in said first arm; and a pair of fastening means for fastening said cover to said top wall of said upstanding member, each of said fastening means extending through said disc and through one of said bores in said top wall of said upstanding member, each of said fastening means being a screw.

4. A battery terminal gripping assembly as in claim 1, further comprising:

a locking assembly for selectively locking said first terminal gripping assembly in a closed position, said locking assembly comprising:

said upstanding member having an annular peripheral wall surface, said annular peripheral wall surface having an annular shoulder therein to define an upper section and a lower section of said upstanding member, said lower section having an external surface having teeth thereon;

an aperture in said first arm, said aperture being located in said front face of said first arm, said aperture being positioned generally adjacent to said central portion of said first arm, said aperture extending into said bore in said first arm; and a pawl for selectively communicating with said teeth in said lower section of said upstanding member, said pawl being hingedly coupled in said aperture, a first end of said pawl being in selective communication with said teeth in said upstanding member;

an urging means in said aperture for urging a second end of said pawl outside of said aperture in a locked position.

5. A battery terminal gripping assembly as in claim 1, further comprising:

a pair of saddles, each of said saddles having a front portion and a back portion each of said front portions having a slot therein, each of said slots having a rounded surface, each of said back portions of said saddles being fixedly coupled to one of said front faces of said distal portions of said first and second arms, each of said slots having a longitudinal axis being oriented generally perpendicular to longitudinal axes of said first and second arms, said saddles comprising conductive material.

6. A battery terminal gripping assembly as in claim 1, further comprising:

a pair of saddles, each of said saddles having a front portion and a back portion each of said front portions having a slot therein, each of said slots having a rounded surface, each of said slots extending generally one-half of a length of said front portion of said saddles, each of said saddles having a plurality of grooves therein, each of said back portions of said saddles being fixedly coupled to one of said front faces of said distal portions of said first and second arms, each of said slots having a longitudinal axis being oriented generally perpendicular to longitudinal axes of said first and second arms, said saddles comprising conductive material.

7. A battery terminal gripping assembly as in claim 5, further comprising:

an insulating means for electrically insulating said first and second arms, said insulating means being a coating on said proximal portions of said first and second arms, said insulating means having a ribbed surface, said insulating means comprising a non-conductive material.

8. A battery terminal gripping assembly, said assembly being removably mountable to terminals of a vehicle battery, said assembly comprising:

a first terminal gripping assembly for gripping a battery terminal, comprising:

a pair of arms, both of said arms having a distal portion, a proximal portion and central portion, both of said arms having a front face for gripping a battery terminal, a back face, a top face and a bottom face, both of said arms having a first bend and a second bend therein, said first bend being generally located between said proximal portion and said central portions said first bend forming an obtuse angle in said back face having a measurement generally greater than one hundred and thirty-five degrees, said second bend being generally located between said distal portion and said central portion, said second bend forming an obtuse angle in said front face having a measurement generally greater than one hundred and thirty-five degrees, each of said arms comprising a conductive material, said arms each having a generally rectangular shaped cross-section transverse to a longitudinal axis of said arms;

a pivoting assembly for pivotally coupling a first and a second arm of said pair of arms, said pivoting assembly comprising:

said first arm of said pair of arms having a bore in said central portion and extending through said top and bottom faces, said front and back faces forming an annular peripheral wall about said bore, said annular peripheral wall having an inside surface having a notch therein, said notch being generally located in said top face of said first arm, said inside surface having an annular ridge therein;

said second arm of said pair of arms having an annular groove in said top face of said central portion, an upstanding member extending upwardly from a medial portion of said annular groove, said upstanding member having a top wall having two bores therein, said top wall having a slot therein, said upstanding member having annular peripheral wall surface, said annular peripheral wall having an annular shoulder therein to define an upper section and a lower section of said upstanding member, said lower section having an external surface having teeth thereon;

a biasing means for biasing said arms in an open position, said biasing means being a torsion spring, said torsion spring being generally wrapped about upstanding member, said torsion spring having a first end extending away from a central portion of said spring and a second end extending toward a central portion of said torsion spring, said first end of said torsion spring being insertable into said notch, said second end being insertable in said slot in said upstanding member;

a securing means for securing said first arm to said second arm, said securing means comprising:

a covering member, said covering member being a disc having a shape rest upon said annular ridge in said bore in said first arm;

a pair of fastening means for fastening said cover to said top wall of said upstanding member, each of said fastening means extending through said disc and through one of said bores in said top wall of said upstanding member, each of said fastening means being a screw;

wherein said biasing means urges said front faces of said first and second arms away from each other;

a locking assembly for selectively locking said first terminal gripping assembly in a closed position, said locking assembly comprising:

an aperture in said first arm, said aperture being located in said front face of said first arm, said aperture being positioned generally adjacent to said central portion of said first arm, said aperture extending into said bore in said first arm, said aperture being elongate having a longitudinal axis orientated generally parallel to said longitudinal axis of said first arm;

a pawl for selectively communicating with said teeth in said lower section of said upstanding member, said pawl having a first end, a second end and middle section, said pawl being positioned in said aperture, a pin hingedly coupling said middle section to an interior surface of said aperture, said first end having a plurality of teeth therein, wherein said pawl locks said first and second arms in a first pivoting position such that said front faces may not move away from each other;

an urging means in said aperture for urging said second end of said pawl outside of said aperture in a locked position, said urging means being insertable in said pawl generally between said second end and said middle section of said pawl, said urging means being a spring;

a pair of saddles, each of said saddles having a front portion and a back portion each of said front portions having a slot therein, each of said slots having a rounded surface, each of said back portions of said saddles being fixedly coupled to one of said front faces of said distal portions of said first and second arms, each of said slots having a longitudinal axis being oriented generally perpendicular to said longitudinal axes of said first and second arms, said saddles comprising conductive material, each of said back portions having a pair of protruding members thereon for insertion into a pair of grooves in each of said front faces of said first and second arms, said saddles being adapted to receive the battery terminal;

a cable for operationally connecting said terminal gripping assembly to a second terminal gripping assembly, said cable having a first end fixedly coupled to said proximal portion of said second arm; and an insulating means for electrically insulating said first and second arms, said insulating means being a coating on said proximal portions of said first and second arms, said insulating means having a ribbed surface, said insulating means comprising a non-conductive material.

9. A battery terminal gripping system comprising:

a terminal gripping assembly for gripping a battery terminal, comprising:

a pair of arms, each of said arms having a distal portion, a proximal portion, and central portion, each of said arms having a front face, a back face, a top face, and a bottom face;

a pivoting assembly for pivotally coupling said first and second arms such that said arms are movable between an open condition and a closed condition, said closed condition of said arms being characterized by the front faces of said arms being pivoted relatively close to each other and said open condition being characterized by the front faces of said arms being pivoted relatively away from each other;

a biasing means for biasing said arms into said open condition;

wherein a first of said arms has a bore in said central portion extending through said top and bottom faces, an annular peripheral wall extending about said bore; and wherein a second of said arms has an annular groove in said top face of said central portion defining an upstanding member, said upstanding member being rotatably received in said bore in said first of said arms.

10. A battery terminal gripping system as in claim 9, wherein said biasing member comprises a torsion spring generally wrapped about said upstanding member and operationally coupled to said first and second arms.

11. A battery terminal gripping system as in claim 9, wherein said pivoting assembly further comprises:

a securing means for securing said first arm to said second arm, said securing means comprising:

a covering member mounted on a top of the upstanding member and extending over the annular groove for holding the upstanding member of the second arm in the bore of the first arm.

12. A battery terminal gripping assembly as in claim 9, further comprising:

a locking assembly for selectively locking said first arm and said second arm in a selected position relative to each other, said locking assembly comprising:

an annular peripheral wall surface on said upstanding member, said annular peripheral wall surface having a plurality of teeth formed thereon;

an aperture formed in the central portion of said first arm and being in communication with said bore in said first arm; and a pawl for selectively interlocking with said teeth on said upstanding member, said pawl being pivotally mounted on said first arm and extending in said aperture, a first end of said pawl being pivotable into and out of interlocking engagement with said teeth formed on said upstanding member;

an urging means for urging said first end of said pawl into interlocking engagement with said teeth, a second end of said pawl extending from said aperture for permitting selective actuation of said second end by a finger of a user to move said first end of said pawl out of interlocking engagement with said teeth and thereby permit pivotal movement of the arms with respect to each other.

13. A battery terminal gripping assembly as in claim 9, further comprising:

a pair of saddles, each of said saddles having a front portion and a back portion, each of said front portions having a slot therein, each of said slots having a rounded surface, each of said back portions of said saddles being fixedly coupled to one of said front faces of said distal portions of said first and second arms, each of said slots having a longitudinal axis being oriented generally perpendicular to longitudinal axes of said first and second arms.

* * * * *